US007121417B2

(12) United States Patent
Magnusson et al.

(10) Patent No.: US 7,121,417 B2
(45) Date of Patent: Oct. 17, 2006

(54) FASTENING DEVICE

(75) Inventors: Reine Magnusson, Västervik (SE); Peter Nilsson, Västervik (SE)

(73) Assignee: Elfa International AB, Vastervik (SE)

( * ) Notice: Subject to any disclaimer, the term of this patent is extended or adjusted under 35 U.S.C. 154(b) by 177 days.

(21) Appl. No.: 10/866,162

(22) Filed: Jun. 14, 2004

(65) Prior Publication Data

US 2005/0011844 A1 Jan. 20, 2005

Related U.S. Application Data

(60) Provisional application No. 60/482,120, filed on Jun. 25, 2003.

(30) Foreign Application Priority Data

Jun. 25, 2003 (SE) ..... 0301849

(51) Int. Cl.
*A47H 1/00* (2006.01)

(52) U.S. Cl. ..... 211/103; 211/103; 211/106; 211/90.02

(58) Field of Classification Search ..... 211/103, 211/86.01, 87.01, 106, 90.01, 46, 90.02, 107, 211/90.03, 112, 90.04, 117, 106.01, 10, 119.002, 211/134, 187, 190, 207, 162, 126.1, 71.01; 108/143, 107; 248/200; 403/329
See application file for complete search history.

(56) References Cited

U.S. PATENT DOCUMENTS 1,880,179 A * 9/1932 Onions ..... 248/243
2,103,106 A * 12/1937 Yurkovitch ..... 248/223.41
2,261,956 A * 11/1941 Brownlie et al. ..... 248/243
3,730,108 A * 5/1973 Stroh ..... 108/108
3,879,144 A * 4/1975 Eckerbrecht ..... 403/232.1
4,515,494 A * 5/1985 Robilliard et al. ..... 403/187
5,048,698 A * 9/1991 Konrad ..... 211/45
5,988,409 A * 11/1999 Gusdorf et al. ..... 211/90.01
6,109,461 A * 8/2000 Kluge et al. ..... 211/90.01
6,273,281 B1 * 8/2001 Berglund ..... 211/187
D464,558 S 10/2002 Trifilio
6,497,395 B1 * 12/2002 Croker ..... 248/300
6,581,789 B1 * 6/2003 Spanski et al. ..... 211/106
6,776,297 B1 * 8/2004 Eustace ..... 211/162

FOREIGN PATENT DOCUMENTS

SE 502 854 10/1994
WO WO 96/10936 4/1996

* cited by examiner

*Primary Examiner*—Richard E. Chilcot, Jr.
*Assistant Examiner*—Lindsay M. Maguire
(74) *Attorney, Agent, or Firm*—Buchanan Ingersoll & Rooney PC

(57) ABSTRACT

A fastening device is for detachable suspension of baskets, paper roll holders, sets of hooks, etc. from a carrier element attached to a wall or door. The fastening device is integrated with the basket, etc. and is adapted to be hooked into slots or through holes in the carrier element. The fastening device includes a central portion with a cross-section corresponding to the cross-section of the central portion of the carrier element. The central portion is substantially U-shaped and includes a base portion and a pair of leg portions extending from the base portion and is formed in one piece with the base portion. The fastening device surroundingly engages the outer periphery of the carrier element, and is insertedly arranged in the basket, etc. The base portion has at least one hook element for releasable engagement with a slot or a through hole in the carrier element.

20 Claims, 3 Drawing Sheets

FASTENING DEVICE

The benefit is claimed under 35 U.S.C. §119(a)–(d) of Swedish Application No. 0301849-6, filed Jun. 25, 2003, and under 35 U.S.C. §119(e) of U.S. Provisional Application No. 60/482,120, filed Jun. 25, 2003.

The present invention relates to a fastening device for detachable suspension of baskets, paper roll holders, sets of hooks etc. from a carrier element attached to a wall or door, said fastening device being integrated with the basket, the set of hooks etc. and adapted to be hooked into slots or through holes in the carrier element and said fastening device comprising a central portion with a cross-section corresponding to the cross-section of the central portion of the carrier element.

More specifically, the invention relates to part of a system for storing various objects suspended from a door, a separate screen wall, a display screen and the like. In cramped quarters and with restricted storage spaces, such as in cupboards, it is important to be able to provide extra storage spaces that do not interfere with the floor surface or available shelf surfaces. One way of achieving this is to mount wire baskets, shelves, suspension hooks, paper roll holders, shoe racks and the like on inner doors or the inside of cupboard doors. It is then advantageous if the baskets, shelves etc. can easily be attached to the door in an optional position or easily be replaced by another unit. Moreover it is of vital importance that the storage system can easily be mounted on and dismounted from the door, when required. Of course, the fastening device according to the invention for detachable suspension of baskets etc. is not limited to carrier elements or rails that are fixed to a door and the like, but a carrier element screwed to a wall or a hang standard hooked to a carrier rail is equally usable for said suspension.

A system for storing various objects suspended from a door is known from U.S. Design Ser. No. 464,558. The system comprises a support rail in the form of a backbone which is intended to be screwed to a door or wall. The support rail comprises a central U-shaped portion whose bottom is intended to abut against a door or the like. A respective flange-formed portion with a number of tongues grouped in pairs projects laterally from the U-shaped portion and parallel with, but at a distance from, the door, to which tongues baskets, racks, shelves etc. can be attached. The baskets etc. have a strong suspension plate which is provided with slots and recesses and adapted to be pushed over the respective pairs of tongues to allow a basket to be suspended from the rail. The suspension plate is attached to the outside of the basket and has a central, U-shaped portion which projects from the basket and whose design corresponds to the U-shaped portion of the support rail and which, when mounting the basket on the support rail, is inserted into the U-shaped portion of the support rail. Thus the support rail is specially designed for this purpose only.

An object of the invention is to provide a fastening device for detachable suspension of baskets etc. from a carrier element attached to a wall, door or the like, allowing easy mounting on and dismounting from the carrier element.

A further object is to provide a fastening device for baskets etc. which is discreetly designed and which affords lateral stability to the basket etc.

Yet another object of the invention is to provide a fastening device for baskets etc. which can be used together with the usual carrier elements, wall rails or hang standards.

One more object is to provide a fastening device for baskets etc. which is relatively inexpensive and easy to manufacture and which does not protrude beyond the basket etc.

According to the invention, these objects are achieved by a fastening device as described by way of introduction, which is characterised in that the central portion of the fastening device is essentially U-shaped and comprises a base portion and a pair of leg portions extending from the base portion and formed in one piece with the base portion, the fastening device being adapted to surroundingly engage the outer periphery of the carrier element, that the fastening device is insertedly arranged in the basket, the set of hooks etc., and that the base portion of the fastening device has at least one hook element for releasable engagement with a slot or a through hole in the carrier element.

Further developments of the invention are defined by the features stated in the subclaims.

Preferred embodiments of the invention will be described below by way of example and with reference to the accompanying drawings, in which FIG. 1 is a front view illustrating a system for storing various objects suspended from a door, a wall or the like, consisting of e.g. a basket, a paper roll holder, a set of hooks, a towel hanger, a shoe rack and a T rack, which by means of a respective fastening device according to the invention are detachably suspended from a carrier element attached to the door, wall or the like;

Figure 1:
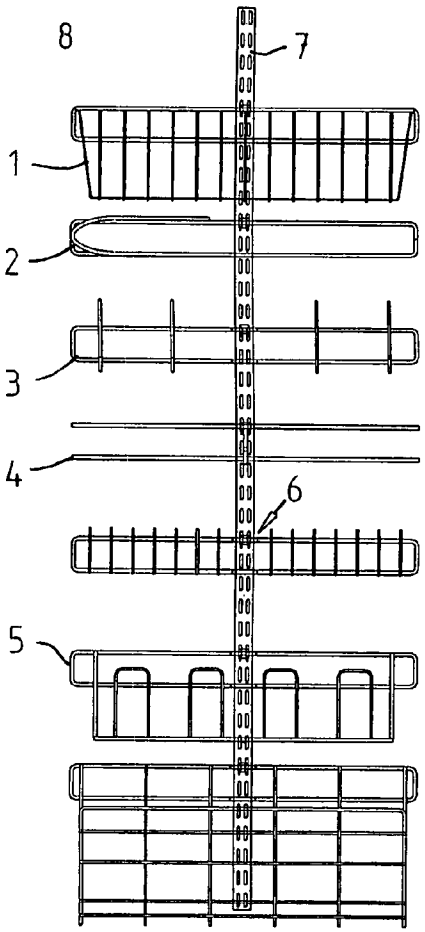

Reference is first made to FIG. 1, which is a front view of a storage system with baskets 1, paper roll holders 2, sets of hooks 3, towel hangers 4, shoe racks 5 etc. which are provided with a fastening device 6 according to the present invention for detachable suspension from a carrier element or rail 7. The carrier element is mounted on a wall 8, door 9 or the like. Preferably the carrier element 7 is a hang standard, such as the hang standards illustrated in the Elfa leaflet "Planerings—och produktguide" and in U.S. Pat. No. 5,110,080. The carrier element thus is an elongate section with a plurality of through slots or holes 11 in one or two rows for detachable hooking on of the baskets 1, the paper roll holders 2 etc. to the carrier element 7. In the drawings, the carrier element is shown to have a U-formed profile, but other profiles are also conceivable such an I-shaped or a T-shaped profile.

The fastening device 6 according to the invention is integrated with the basket 1, the paper roll holder 2, the set of hooks 3 etc., i.e. it is essentially formed in one piece with the basket etc. (FIGS. 1–5) or is fixedly attached to the basket etc. (FIGS. 6–10). Moreover the fastening device 6 comprises a central, essentially U-shaped portion having hook elements 17 for releasable engagement with the slots or holes 11 of the carrier element 7, as will be described in more detail below.

Figure 2:
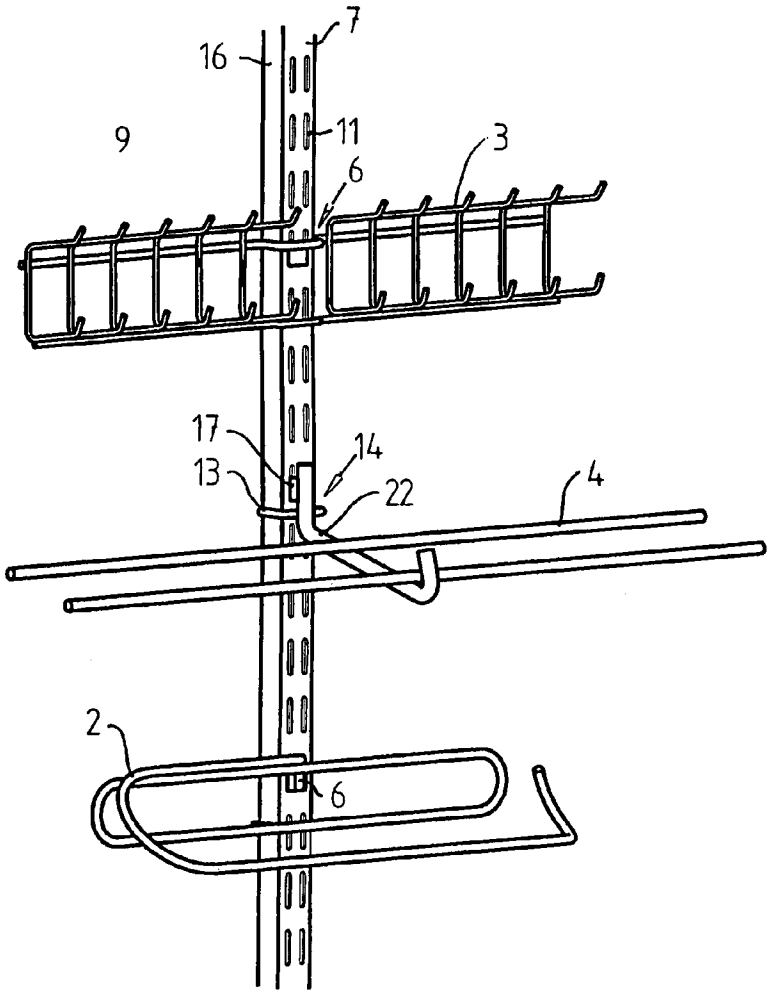
FIG. 2 is a partial perspective view and shows the system in FIG. 1 on an enlarged scale.
Figure 3:
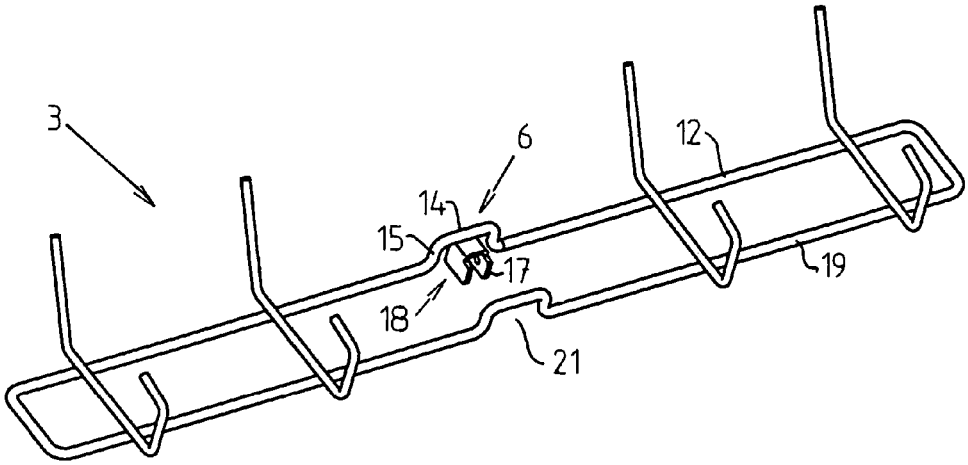
FIG. 3 is a perspective view and shows on a further enlarged scale a set of hooks included in the system with an embodiment of the fastening device according to the invention shown in detail.
Figure 4:
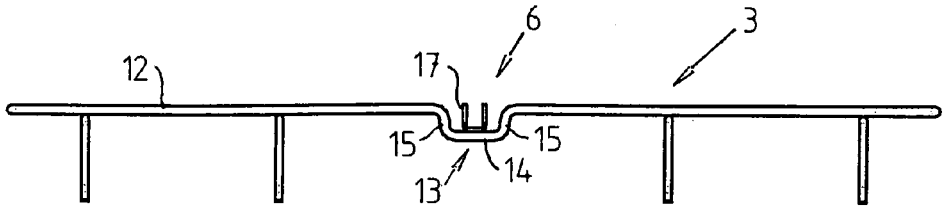
FIG. 4 is top plan view of the set of hooks in FIG. 3.
Figure 5:
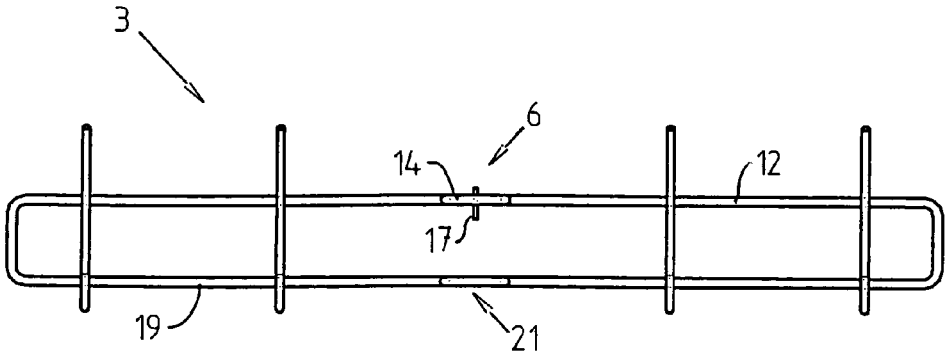
FIG. 5 is a front view of the set of hooks in FIG. 3 but with an alternatively designed hook device.

With reference to FIGS. 3–5, which are different views of a set of hooks 3 with a fastening device 6, which is essentially formed in one piece with the set of hooks. The fastening device is a U-shaped bend of the upper wire 12 of the set of hooks having a central portion 13 which comprises a base portion 14 and a pair of leg portions 15 extending from the respective ends of the base portion. The fastening device surrounds the carrier element 7 with its base portion 14 and its leg portions 15 and these portions 14, 15 abut against the outer periphery 16 of the carrier element (see FIG. 2). The leg portions 15 are preferably so long that the upper wire 12, when mounting the set of hooks 3 on the carrier element 7, will abut exactly against the wall 8 or door 9 to which the carrier element is attached.

The fastening device also comprises at least one hook element 17 with which the set of hooks 3 is hooked to the carrier element 7 by the hook element being inserted into a selected slot 11 in the carrier element. The hook element 17 is fixedly attached to the base portion 14 of the fastening device, for instance by welding, soldering or gluing. FIGS. 3 and 4 show a substantially U-shaped hook device 18 fixedly attached to the base portion 14, and a hook element 17 is formed at each free end of the hook device 18. FIG. 5 illustrates schematically a single hook element attached to the base portion 14. However, the hook element is not restricted to the design shown in FIGS. 1–5 but may have an optional design which is then complementary to the shape of the through holes in the carrier element, into which through holes the set of hooks etc. is to be hooked.

In order to further stabilise the suspension of the set of hooks 3 from the carrier element, its lower wire 19 (or the lowermost wire of the basket 1 adjacent to the carrier element) is bent at the centre of the set of hooks in the same way as the upper wire 12 to form a portion or recess 21 extending into the set of hooks etc. This portion will then also surround and abut against the carrier element 7.

FIGS. 3–5 illustrate the hook element 17 positioned essentially on the same level as the central portion 13 or the upper wire 12. The hook element, however, can be arranged at a level different from the central portion, i.e. above the central portion 14. As shown in FIG. 2, the central portion 13 of the towel hanger 4 is a separate U-shaped unit which is fixedly attached to the wire 22 which supports the actual towel hanger. This wire is fixedly attached to the base portion of the fastening device, although on the opposite side (outside) of the base portion 14 in relation to that shown in FIGS. 3–5. The wire 22 extends upwards from the base portion and is terminated in hook elements 17 to be inserted into a slot or through hole in the carrier element.

Reference is now made to FIGS. 6–10, which illustrate a different embodiment of the fastening device 6 according to the invention. In this embodiment, the fastening device is not formed in one piece with the basket 1, the paper roll holder 2, the set of hooks 3 etc., but is a separate unit which is fixedly attached to the basket etc., for instance by welding, soldering, gluing, in a recess therein (see FIG. 6). The base portion 14 and leg portions 15 of the fastening device 6 are made of a metal sheet bent in U shape and with hook elements 17 formed in the base portion. A pair of flanges 23, to which the basket etc. is attached, project perpendicularly from the free ends of the leg portions 15, i.e. their ends not connecting to the base portion 14. The flanges are formed in one piece with the rest of the fastening device. Alternatively, the fastening device can be made of a material other than metal, such as reinforced plastic.

Each hook element 14 is formed as a tongue punched from the base portion 14 and having a first portion, or connecting portion 24, a second or intermediate portion 25 and a third portion or end portion 26. The intermediate portion 25 extends essentially parallel with the base portion 14 and is positioned by means of the connecting portion 24 at a distance from the inner surface 27 of the base portion that corresponds to the material thickness of the carrier element 7. In order to facilitate the insertion of the tongue into the slot 11 of the carrier element, the end portion 26 is angled away from the base portion 14 and forms an acute angle to this. Preferably, the intermediate portion 25 adjacent to the end portion 26 is positioned at a shorter distance from the inner surface 27 of the base portion than is the intermediate portion 25 adjacent to the connecting portion 24, in which case the hook element will clamp the fastening device 6 to the carrier element 7.

Figure 10:
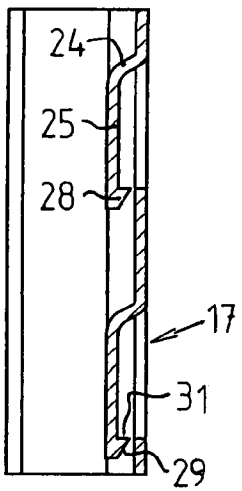
FIG. 10 is a section corresponding to the one in FIG. 9, schematically illustrating an alternative embodiment of the fastening device in FIGS. 7–9.
Figure 7:
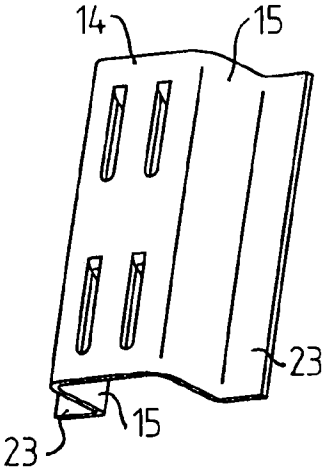
FIG. 7 is a front perspective view of a fastening device according to FIG. 6, separated from the basket.

FIG. 10 schematically presents an alternative embodiment of the hook element 17. In this embodiment, the angled end portion 26 has been replaced by a hook-shaped end 28 with a sliding surface 29 and an abutment surface 31. The distance between the abutment surface 31 and the connecting portion 24 of the hook element is somewhat greater than the distance between the lower edge of a slot 11 in the carrier rail and the upper edge of a subjacent slots 11', see FIG. 6. When inserting the hook element or tongue 17 into the slot 11, the sliding surface 29 will press the intermediate portion 25 outwards and the hook-shaped end 28 will finally, owing to the elasticity of the hook element, snap into the subjacent slot 11', thereby locking the fastening device to the carrier element by means of the abutment surface 31.

Figure 8:
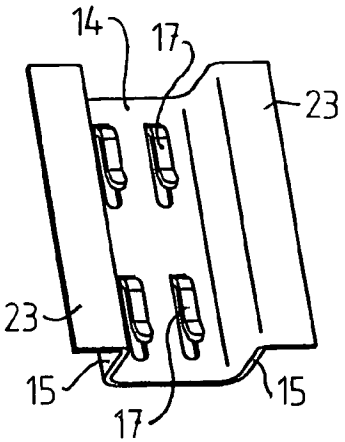
FIG. 8 is a rear perspective view of the fastening device in FIG. 7.
Figure 9:
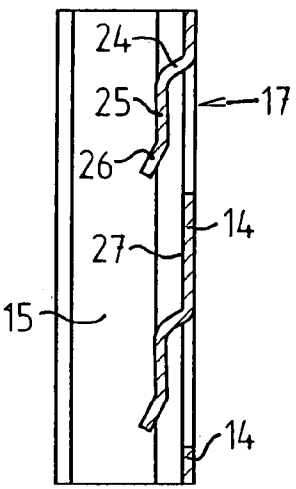
FIG. 9 is a central longitudinal section of the fastening device in FIGS. 7 and 8.
Figure 6:
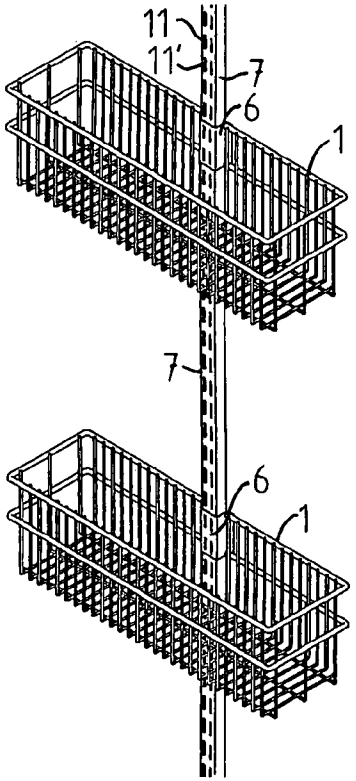
FIG. 6 is a partial perspective view, corresponding to the one in FIG. 2, illustrating a pair of baskets detachably suspended from a carrier element by means of an alternative, preferred embodiment of the fastening device according to the invention.

To achieve optimal stability in the hooking-on of a basket 1 etc. to a carrier element 7, the fastening device comprises at least two separate (pairs) hook elements which are aligned with each other in the longitudinal direction of the fastening device, as shown, for instance, in FIGS. 8 and 9. The lower edge or bottom of the basket etc. is in any case formed with an inwardly extending portion or recess 21, as indicated in connection with FIG. 3.

By the fastening device according to the invention being insertedly arranged in the basket etc., the basket will also be easier to packet.

In the illustrated embodiments of the storage system, all baskets, paper roll holders, sets of hooks etc. are shown to be made of wires. As will be easily understood, they may, however, be made of an optional material, without deviating from the inventive idea. For instance, the basket can be made of sheet metal and then according to FIGS. 6–10 the fastening device is conveniently formed in one piece with the side of the basket facing the wall or the like.

The invention is not limited to that described above or shown in the drawings, and can be modified within the scope of the appended claims.

The invention claimed is:

1. A fastening device for detachable suspension of baskets, paper roll holders, sets of hooks from a carrier element attached to a wall or door, said fastening device being integrated with the basket, the set of hooks and adapted to be hooked into slots or through holes in the carrier element and said fastening device comprising a central portion with a cross-section corresponding to the cross-section of the central portion of the carrier element, wherein the central portion of the fastening device is essentially U-shaped and comprises a base portion and a pair of leg portions extending from the base portion and formed in one piece with the base portion, the fastening device being adapted to surroundingly engage the outer periphery of the carrier element, that the fastening device is insertedly arranged in the basket, the set of hooks, and that the base portion of the fastening device has at least one hook element for releasable engagement with a slot or a through hole in the carrier element.

2. A fastening device as claimed in claim 1, wherein said at least one hook element is arranged adjacent to the upper portion of the basket, the set of hooks, and that a U-shaped recess is insertedly arranged in the lower portion of the basket, the set of hooks, said recess surrounding the carrier element.

3. A fastening device as claimed in claim 2, wherein the leg portions and the base portion of the fastening device are formed integrally with the basket, the set of hooks, and that at least one hook element is fixedly attached to the base portion.

4. A fastening device as claimed in claim 2, wherein the fastening device comprises at least two separate hook elements which are aligned with each other in the longitudinal direction of the fastening device.

5. A fastening device as claimed in claim 1, wherein the leg portions and the base portion of the fastening device are formed integrally with the basket, the set of hooks, and that at least one hook element is fixedly attached to the base portion.

6. A fastening device as claimed in claim 5, wherein a substantially U-shaped hook device is fixedly attached to the base portion of the fastening device, a hook element being formed at each free end of the hook device.

7. A fastening device as claimed in claim 6, wherein the fastening device comprises at least two separate hook elements which are aligned with each other in the longitudinal direction of the fastening device.

8. A fastening device as claimed in claim 5, wherein the fastening device comprises at least two separate hook elements which are aligned with each other in the longitudinal direction of the fastening device.

9. A fastening device as claimed in claim 1, wherein the hook element is arranged at a distance from the base portion of the fastening device.

10. A fastening device as claimed in claim 9, wherein the fastening device comprises at least two separate hook elements which are aligned with each other in the longitudinal direction of the fastening device.

11. A fastening device as claimed in claim 1, wherein the leg portions and the base portion of the fastening device are made of a metal sheet bent in U shape and fixedly attached to the basket, the set of hooks, in a recess thereof, and from which metal sheet at least one tongue projecting from the base portion is formed, said tongue constituting said hook element.

12. A fastening device as claimed in claim 11, wherein the metal sheet bent in U shape also comprises a pair of flanges, which project perpendicularly from the free end of the respective leg portions and which are integrally formed with said metal sheet, and that the basket, the set of hooks is fixedly attached to said flanges.

13. A fastening device as claimed in claim 12, wherein said tongue is integrally formed with the base portion of the fastening device, extends essentially parallel with the base portion and is terminated with an end directed away from the base portion and forming an acute angle thereto.

14. A fastening device as claimed in claim 12, wherein the fastening device comprises at least two separate hook elements which are aligned with each other in the longitudinal direction of the fastening device.

15. A fastening device as claimed in claim 11, wherein said tongue is integrally formed with the base portion of the fastening device, extends essentially parallel with the base portion and is terminated with an end directed away from the base portion and forming an acute angle thereto.

16. A fastening device as claimed in claim 15, wherein the tongue adjacent to said angled portion is arranged at a shorter distance from the base portion than is the rest of the portion of the tongue, which is essentially parallel with the base portion.

17. A fastening device as claimed in claim 15, wherein the fastening device comprises at least two separate hook elements which are aligned with each other in the longitudinal direction of the fastening device.

18. A fastening device as claimed in claim 11, wherein said tongue is formed with a hook-shaped end which is directed towards the base portion and adapted to be hooked into a slot or a hole above or below the slot or hole into which the hook element is inserted when suspending the basket, the set of hooks.

19. A fastening device as claimed in claim 11, wherein the fastening device comprises at least two separate hook elements which are aligned with each other in the longitudinal direction of the fastening device.

20. A fastening device as claimed in claim 1, wherein the fastening device comprises at least two separate hook elements which are aligned with each other in the longitudinal direction of the fastening device.

* * * * *